US005088436A

United States Patent [19]

Stritmatter

[11] Patent Number: 5,088,436

[45] Date of Patent: Feb. 18, 1992

[54] APPARATUS FOR CHARGING GAS PRESSURIZED BEVERAGE STORAGE AND DISPENSING SYSTEMS

[75] Inventor: Ronald L. Stritmatter, Fort Worth, Tex.

[73] Assignee: Thad Keenan, Fort Worth, Tex.

[21] Appl. No.: 503,326

[22] Filed: Apr. 2, 1990

[51] Int. Cl.[5] ..... F17C 5/02

[52] U.S. Cl. ..... 141/234; 141/2; 141/3; 141/18; 137/263; 62/50.7

[58] Field of Search ..... 141/2, 3, 18, 44, 197, 141/234, 236, 237, 238, 242, 244; 62/50.4, 50.7, 388, 48.1, 50.1, 50.2, 53.2; 137/154, 263, 266, 267

[56] References Cited

U.S. PATENT DOCUMENTS

| | | | |
|---|---|---|---|
| 2,384,677 | 9/1945 | Hill | 62/50.1 X |
| 2,400,570 | 5/1946 | Norway | 62/50.2 |
| 2,405,998 | 8/1946 | Buttner et al. | 62/50.2 |
| 3,018,635 | 1/1962 | Keckler | 62/50.4 |
| 3,234,745 | 2/1966 | Johnson | 137/263 |
| 3,302,418 | 2/1967 | Walter | 62/50.2 |

FOREIGN PATENT DOCUMENTS

| | | | |
|---|---|---|---|
| 1434208 | 10/1988 | U.S.S.R. | 141/18 |

*Primary Examiner*—Henry J. Recla
*Assistant Examiner*—Casey Jacyna
*Attorney, Agent, or Firm*—John M. Cone

[57] ABSTRACT

Apparatus for charging storage cylinders with a cryogenic gas comprises a mobile storage tank for the gas in liquid phase, fill and return lines that can be connected between the tank and a valve manifold at a remotelly located site at which the storage cylinders are located. The valve manifold receives incoming liquid gas and diverts some of it to a number of cylinders in which it is stored in liquid form and, after the remainder, after a controlled expansion to gas phase, to a cylinder which converts to a beverage dispensing system at the remote location. The system comprises fill and return lines to avoid venting gas to atmosphere during the filling process.

4 Claims, 5 Drawing Sheets

APPARATUS FOR CHARGING GAS PRESSURIZED BEVERAGE STORAGE AND DISPENSING SYSTEMS

FIELD OF THE INVENTION

The present invention relates to apparatus for charging cylinders with liquid, inert, cryogenic gases, such as carbon dioxide and nitrogen, at high pressure, for use in, for example, beverage dispensing systems. In particular, the invention relates to the filling from a remote tank of storage cylinders used for storing liquid and gaseous phase, cryogenic gases for use in such systems. By "cryogenic" is meant gases that are liquifiable by reduction of temperature or increase of pressure.

BACKGROUND OF THE INVENTION

It is well known that soda fountains in restaurants and bars typically dispense carbonate beverages by mixing water and a beverage syrup together with carbon dioxide gas, which both provides the carbonation in the beverage and acts as a propellant to withdraw syrup from storage containers.

DISCUSSION OF THE PRIOR ART

U.S. Pat. No. 2,469,434 (Hansen, discloses a method for filling gas storage cylinders in which vapor is withdrawn from the system by evacuating the cylinders into a separate storage area, thus allowing them to be replenished with liquified gas.

Other prior art is exemplified by U.S. Pat. No. 3,003,325 (Poethig, et al) which discloses a method for preventing substantial increase in vapor pressure within a tank during filling operations in which the liquid is introduced at full speed directly to the bottom of the tank while utilizing a venturi valve to aspirate the vapor space, which allows the vapor to be sucked from the top of the tank and introduced into the liquified carbon dioxide flow to the bottom of the tank. This method allows the absorption of the latent heat from the vapor by driving it into intimate direct contact with liquid in the receiving tank while receiving the contents of the storage tank through only a single pressure fill line.

U.S. Pat. No. 2,912,830 (Coldren, et al) discloses a method of filling a closed container with volatile liquid in which volatile liquid from a source outside the container is flowed, prior to discharge into the container, at a substantial velocity through an eductor generating a low pressure therein. Vapors of substantially the same composition as said liquid are withdrawn from said container solely by the action of said generated low pressure and mixed with the liquid supplied to the eductor. Said liquid and vapors are introduced into the container to progressively increase the contents thereof, through the steps of: flowing part of the volatile liquid from the source directly into the container without initially contacting the vapor in said eductor; and then reducing the velocity of the flow through the eductor when the pressure in the top of the closed container is reduced to the vapor pressure of the tank contents at tank pressure, and passing amounts of the volatile liquid directly to the closed container by other than the conduit means so that the volume of the liquid passing to the container is not reduced.

When liquified gas storage tanks are replenished in accordance with the methods disclosed in the prior art with a is rapidly compressed. The temperature of this gas will increase unless the pressure is high enough to overcome the triple point (the point where pressure alone can liquify the gas), at which time the vapor will return to liquid. Without a pressure increase, the temperature of a liquifiable gas will always increase during expansion, thereby making it difficult to add liquified, colder gas to a partially full vessel and attain a completely full storage vessel. In order to condense the vapor, its sensitive heat must be reduced and its latent heat of vaporization removed, overcoming the triple point of the gas by subjecting it to high pressure.

Various attempts have been made in the past to prevent this pressure rise in storage tanks. One of these is to provide a separate line for the vapor to bleed off to atmosphere in order to balance the pressure between the storage tank and the supply tank. Utilizing this method during the filling operation could be extremely dangerous in high-pressure applications. Another method utilizes bleeding the vapor to atmosphere during the filing operation, but this also could be highly dangerous.

Refrigeration of the storage tanks produces a workable solution, but is expensive and cumbersome. Spraying the liquid into the vapor space of the storage tank is a possible alternative, as demonstrated in U.S. Pat. No. 2,813,402 (Billings).

In U.S. Pat. No. 4,683,921 (Neeser) liquid $CO_2$ is delivered from a $CO_2$ tank on a delivery truck 48 to a liquid $CO_2$ tank 14 within the building. $CO_2$ is withdrawn from the tank 14 and is supplied, via a pressure regulator, in gaseous form to a mixing valve 20 at a pressure of about 90 psig. Neeser, however, is concerned principally with delivery of syrup in a beverage system and does not disclose apparatus or method necessary to store the $CO_2$.

PRINCIPAL OBJECTS OF THE PRESENT INVENTION

The principal object of the present invention is to provide a system of charging storage cylinders with liquid, cryogenic gas, by increasing the gas pressure to a point sufficient to overcome the triple point and allow liquification, and in which the latent heat of vaporization is removed from the storage cylinders that hold liquid gas. Another object of the invention is to provide an overall system check for monitoring the pressures involved during the filling process, as well as the regular operational capacities for transforming the liquid to gas.

Another object of the invention relates to the provision of a valve manifold, which allows direct connection to the high-pressure storage cylinders by direct connection to flow valves of the manifold thereby eliminating the need for exterior plumbing.

It is a further object to provide all operating valves in a customized pressure manifold which can be directly connected to the storage cylinders without the aid of exterior or flexible plumbing lines. Only one flexible line is thus required to connect the customer's regulator to the various components in a fountain system.

Increased safety is also an important object of this invention which utilizes standard burst protection discs on the cylinders, relief valves in the operating mode of the normal valve manifold operation and a system unloading or dump valve in the event that extreme heat, such as in the case of a fire occurs.

It is a further object to provide a system with the ability to dump the high-pressure contents of liquid and gaseous tanks safely to the exterior atmosphere of the building in the event of excessive pressure caused by an extreme exposure to heat or fire. In such case, a main safety relief valve will start to release pressure throughout the overall system. If the extreme condition occurs when the system is not functioning, a system dump valve (an auxiliary relief valve) will be activated at over 1700 psi to allow the entire contents of the storage cylinders to vent to atmosphere.

It is a further object to provide a system with the ability to fill the cylinders without venting the gas or liquid to atmosphere by establishing a closed loop between the delivery truck via one fill line and one return line, and reducing the pressure of gas returned to the truck tank below 350 psi.

It is also an object of the invention to automate the bulk filling process by means of control sensors adapted to shut the delivery pump down once the fill process has been completed, thereby obviating the need for operator control during the filling process.

It is a further object of the invention to provide a bulk fill delivery system which allows a storage system to be replenished without an operator having to enter the remote storage tank facility and make any adjustment to the storage vessels or their associated plumbing of the overall system and to provide a bulk fill delivery system which allows the system to be replenished without interrupting service to other beverage dispensing systems which require the pressurized gas to operate. Interrupting service to the dispensing systems could require shutting down those systems and prevent the sale of soft drinks, beer, or metered gases.

It is a yet further object of the invention to provide a bulk fill delivery system which utilizes an individual quick-coupler device to attach itself to a remote storage facility. These quick couplers incorporate the double end double shut-off concept of utilizing a flow check valve in each end of the coupler to restrict flow so that when the coupler is apart in two pieces, the high-pressure flow cannot escape through the end of the line open to atmosphere; whereas, when connected, flow can occur in one direction only, as specified.

A final object of the invention is to provide the ability to fill high-pressure inert gas storage tanks without having to transport them to a remote location and disconnect the empty tanks and reconnect the replenish ones. The high-pressure storage system of the invention allows several times the amount of gas to be stored in a given volume of cylinder, compared to conventional low-pressure tanks, so that less storage space will be needed for cylinders changed using the present invention.

SUMMARY OF THE INVENTION

According to the present invention, there is provided in an apparatus for charging cylinders with an inert gas comprising a valve manifold, containing means permitting liquified gas to become gasified by reducing its pressure, thereby allowing the storage of the gas produced in another storage vessel for consumption by standardized gas dispensing systems.

The valve manifold provides a closed loop filing circuit from the delivery truck to the storage tanks. This allows for automation of the filling process by sensing either the fill line, or return line, pressures, and the generation of a signal, based on the pressure differential, which shuts off the pumping system on the delivery truck. The sensing can be achieved either mechanically or electrically. A closed loop filling circuit allows the storage tanks to be filled and excess liquified gas to be returned to the delivery truck, without venting either liquid or gas to the atmosphere from the storage tanks during the fill process.

BRIEF DESCRIPTION OF THE DRAWINGS

The invention will now be described by way of example only, with reference to the accompanying drawings.

DESCRIPTION OF THE PREFERRED EMBODIMENT

Figure 1:
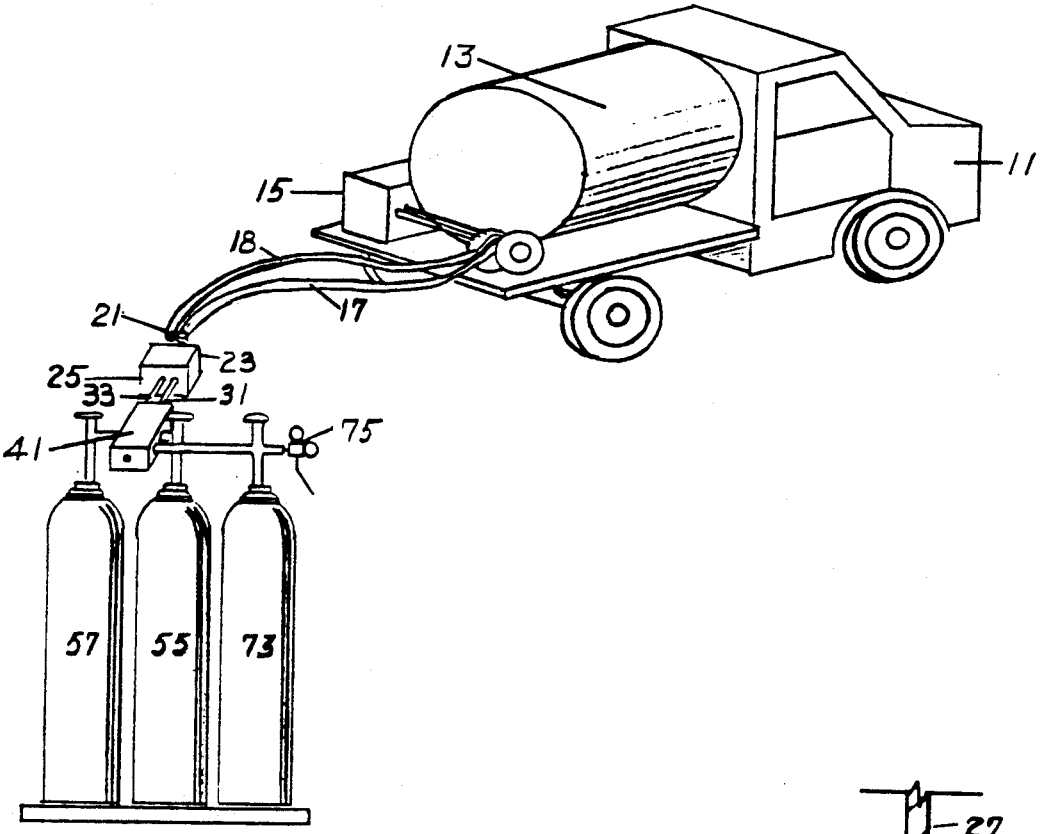
FIG. 1 is a general schematic representation of apparatus embodying the invention used for delivering liquid carbon dioxide to a storage cylinder of a beverage dispensing system located inside a building from a mobile tank outside the building.

Referring to FIG. 1, a truck 11 carries a storage tank 13 containing liquid $CO_2$ at a pressure of about 350 psi. An outlet (not shown) from the tank 13 is connected to a computerized flow meter 15 and from there to a hose 17 normally stored coiled on a reel 19 rotatably mounted on the truck 11. A return hose 18 is also stored on the reel 19 and is also connected to the tank 13.

Figure 5:
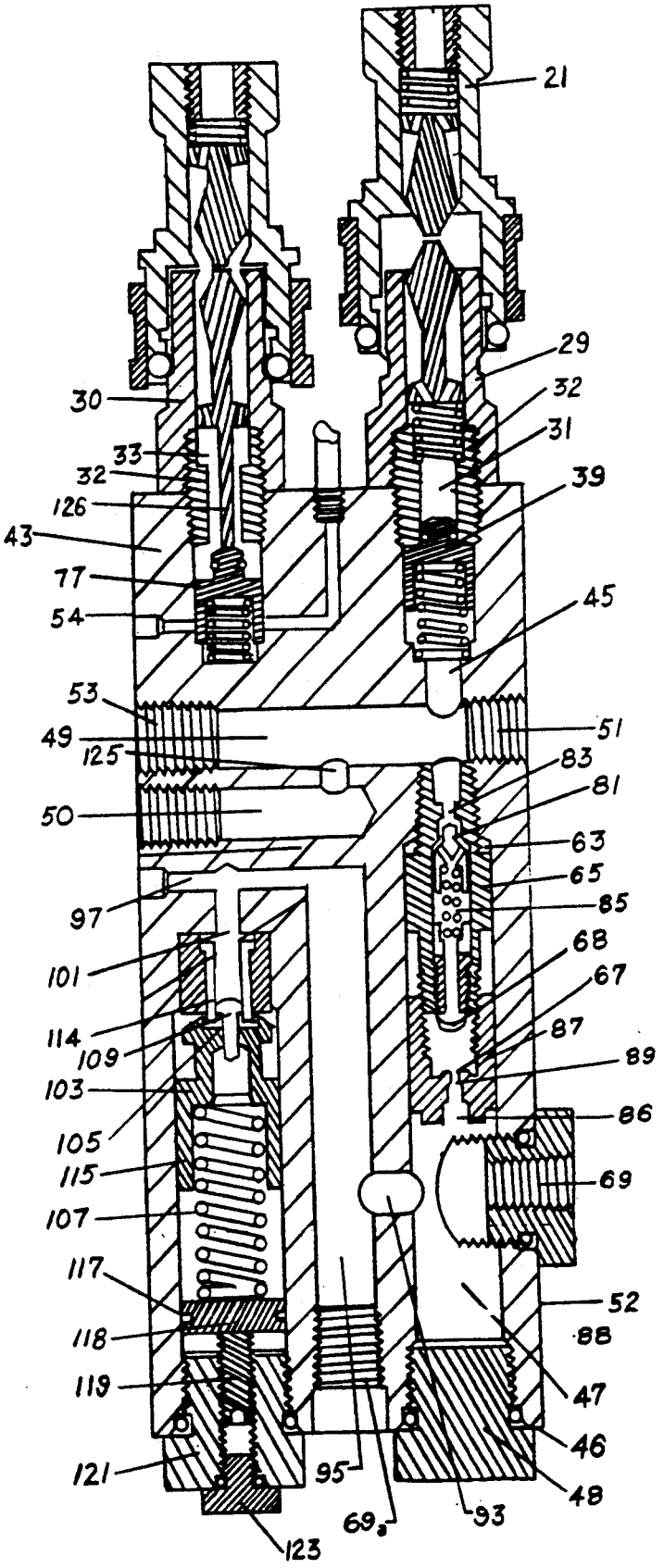
FIG. 5 is a horizontal cross-section on the same plane as FIG. 2 showing the valve bodies of the valve manifold that were omitted from FIG. 4.

As shown in FIG. 1, the hoses 17 and 18 pass, in use, through a fill box 25 mounted in an exterior wall 27 of a remote storage location, such as a restaurant. The outboard ends of the hoses 17 and 18 are provided with female quick-coupling elements 21 which mate with a pair of male quick-connect couplers 29 and 30 (FIG. 5), which connect via nipples 32 with an entrance port 31 and return port 33, respectively, of a valve manifold 41 embodying the present invention and housed inside the restaurant. In FIG. 5, the coupler 29 is shown uncoupled and the coupler 30 is shown coupled.

Figure 4:
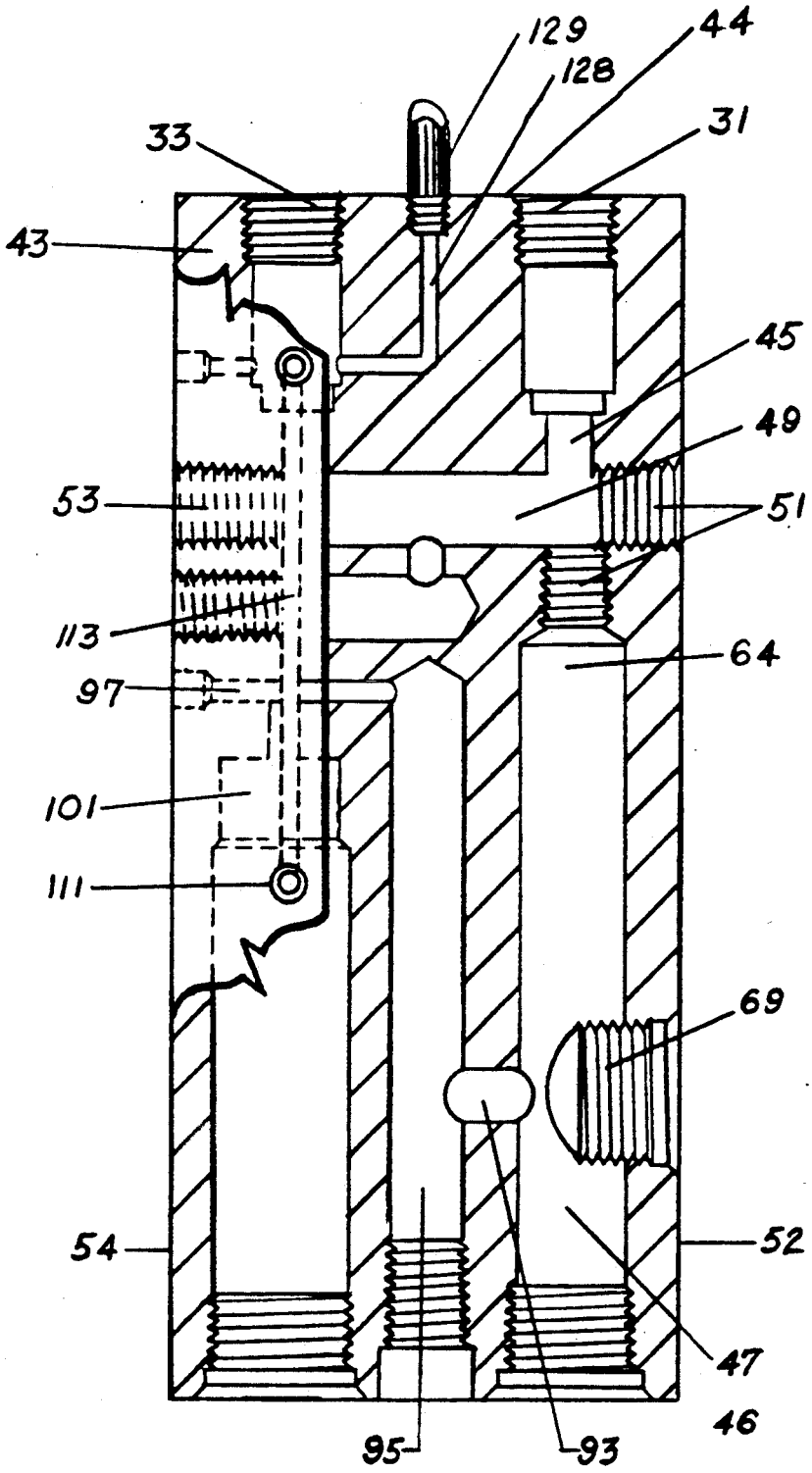
FIG. 4 is a horizontal cross-section of the valve manifold which interconnects the storage cylinders of the apparatus of FIG. 1, with internal valve parts removed.

As best seen in FIG. 4 and 5, the valve manifold 41 comprises a main body 43 of substantially rectangular cross-section in both horizontal and vertical aspects, with the horizontal dimensions being greater than the vertical one. The ports 31 and 33 are disposed in an end face 44 of the body 43. The entrance port 31 communicates with an internal passage 45 which extends substantially orthoganally to the end face 44 through the body 43 and terminates in a port 47 in the opposite end face 46 of the body 43. The port 47 is sealed by a closure plug 48.

Figure 2:
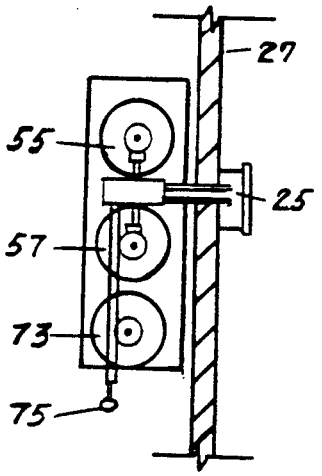
FIG. 2 is a plan from above of the storage cylinders shown in FIG. 1.
Figure 3:
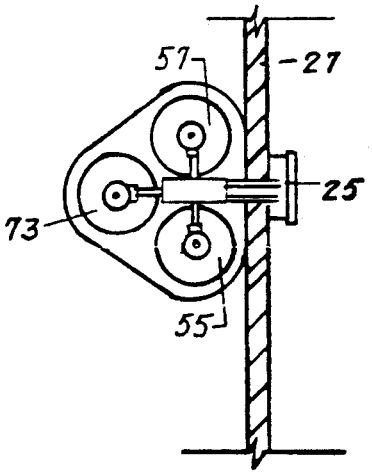
FIG. 3 is a plan shown above of an alternative arrangement for the storage cylinders.

Immediately within the body 43 downstream from the entrance port 31 the passage 45 houses a check valve 39. A horizontal cross-bore 49 extends at right angles to the passage 45 downstream from the valve 48 and interconnects a pair of exit ports 51 and 53 in opposite side faces 52 and 54 of the body 43. Pressure bottles 55 and 57 (FIG. 1) for containing liquid $CO_2$ are connected directly to the exit ports 51 and 53, respectively without external plumbing. On the other, downstream, side of the cross-bore 49, the passage 45 has an internally screw-threaded throat 58 communicating with an increased diameter portion 63 of the passage 45, which provides a chamber 64 in which are housed a pressure differential valve 65 (FIG. 5) and atomizing choke 67 (FIG. 5), described in more detail below. A main exit passage 69 extends through the body 43 at right angles to the passage 45 to the side face 52 of the body 43. A screw connector 71 is mounted in the exit passage 69 to which, in use, a third pressure bottle 73 (FIG. 1 and FIG. 2) is connected. The manifold 41 also includes an exit passage **69*a* in the end face 46 which, in the form of the invention shown in FIG. 2, is closed by a screw-threaded cap (not shown) engaged in the exit passage 69*a*. The exit passage 69*a* is used to connect the third pressure bottle 73 in the configuration of bottles in FIG. 3, in which case the exit passage 69** is sealed by a screw-threaded cap (not shown).

It will be appreciated by those skilled in the art that additional storage bottles for liquid carbon dioxide could be attached to the manifold 41 via passage 50 (FIG. 5). If no extra bottle is attached, the passage 50 would, of course, be sealed.

The pressure differential valve 65 maintains a pressure differential of at least 150 psi between high-pressure, incoming liquid $CO_2$ from the inlet port 31, and $CO_2$ flowing from the liquid bottles 55 and 57 to the valve 65. The exact pressure differential required will vary for different gases depending on the compressibility ratio of the gas in relation to its triple point.

The valve 65 comprises a movable closure member 81, which is normally held against an inlet orifice 83 by means of a coil spring 85. From the valve 65, the $CO_2$ flows into the atomizing choke 67, where it is transformed into gas, and from which it flows to the exit passage 69. The atomizing choke 67 is disposed downstream from the valve 65 and receives liquid $CO_2$ from the valve 65. As best seen in FIG. 5, the choke 67 houses within its interior a foraminous diffusion cap 68. The downstream end of the choke 67 provides a central exit passage 86 surrounded by an upstanding, upstream projecting, rebated lip 87, which presents an annular channel 89 open toward the interior walls of the choke 67. Liquid gas dispersed through the cap 68 is subjected to further turbulence by the restriction to through flow provided by lip 87. The central exit passage 86 provides at its downstream end a relatively small orifice of, for example, 1/64 to 3/64 inch diameter leading into a relatively larger diameter downstream end portion 88 of the passage 45, just upstream of the exit passage 69.

In this embodiment, the matching of a pressure differential valve with a proportionate sized expansion chamber with regulated flow through a choke allows the controlled release of pressure which generates heat, in proportion to the amount of liquid allowed to enter the expansion chamber. Accordingly, the embodiment creates a controlled transfer of $CO_2$ from the liquid to the gaseous phase. The heat transfer encompassed by this phase change is stored in the third bottle to which the gas passes through the exit port 69, maintaining the $CO_2$ in gaseous form even though the tank 73 is under high pressure.

In the form of manifold shown in FIG. 4 and 5, the downstream end of the passage 45 communicates, at a position opposite the exit passage 69, with an inwardly extending cross-passage 93, which leads to a return passage 95 that extends parallel to the passage 45 approximately along the center line of the body 43.

The return passage 95 communicates, via a cross-passage 97, with one end of a relief valve chamber 101, which is located within the body 43 and extends substantially parallel to and in alignment with the downstream end portion of the passage 45. A relief valve 103 is located within the chamber 101 and comprises, see FIG. 5, a poppet 105 mounted on a valve body 115. The valve body 115 carries a PTFE seal 109 which surrounds the poppet 105 and is normally urged by spring 107 in a direction to seat the seal 109 against an inlet 114 to the chamber 101, closing off the cross-passage 97 from communication with a vertically extending passage 111, the lower end of which terminate within the chamber 101, and which communicates with a main return passage 113 within the body 43 which, in turn, communicates with the return port 33 and relief passage 54.

The end of the spring 107 remote from the inlet 114 is secured in a closure disc 118 which is movable axially through the chamber 101 and seals against the side of the chamber 101 by means of a PTFE "O" ring 117. An allen head screw-threaded shaft 119, secured to the closure disc 118, extends through a plug 121 in the end of the chamber 101, and is provided with a locking cap 123 at its exterior end. Rotation of the shaft 119 allows, as described below, for the adjustment of the pressure at which the valve 103 operates.

In use, liquid $CO_2$ at approximately 1000–1200 psi is pumped from the tank 13 by means described below, through the supply hose 17 to the fill box 25 and from there to the entrance port 31 of the manifold 41. The liquid $CO_2$ passes through the upstream portion of the passage 45 and into the cross-bore 49 to fill the two pressure bottles 55 and 57 connected to the exit ports 51 and 53.

The high-pressure liquid $CO_2$ also opens the pressure differential valve 65 by compressing the spring 85, allowing liquid $CO_2$ to pass through the valve 65 to the atomizing choke 67. As the liquid $CO_2$ passes through the diffusion cap 68, discrete drops are formed which are diverted downwardly and outwardly from the downstream end of the passage 45 by the cap 68 and impact the side and end walls of the choke 67. The impacted drops are restrained from direct onward motion out of the choke 67 by the lip 87. The flow turbulence thus produced creates a hystereses, which generates heat, allowing the $CO_2$ to change from liquid to gaseous phase. Gaseous phase $CO_2$ finally pass through the central exit passage 86 of the choke 47 and expands at the exit of the passage 86 to provide gaseous $CO_2$ at a pressure which is always at least 150 psi less than the pressure of the liquid $CO_2$ upstream of the pressure differential valve 65.

In use, as gaseous $CO_2$ is withdrawn from the bottle 73, through a standard pressure regulator valve (not shown), reducing the pressure in the bottle 73, liquid $CO_2$ is continuously fed from the bottles 55 and 57 to the pressure differential valve 65 and choke 67, converted to the gaseous phase, and fed to the bottle 73.

The gaseous $CO_2$ flows from the choke 67 through the exit port 69 to the pressure bottle 73 and also through the cross-passage 93 and return passage 95 to the relief valve 103. The operating pressure of the relief valve 103 is set using the adjusting screw shaft 119, rotation of which moves the closure 115 axially within the chamber 101 to load or relieve the spring 107. When the pressure of gas in the return passage 95 is sufficient to overcome the force of the spring 107, the poppet 105 unseats from the inlet 114 allowing the gas to escape from the cross-passage 97 via the inlet 114 and the exit passage 111, to the passage 113 and thence to the port 33, venting to atmosphere through a port 128. A metal drain tube 129 may be connected to the port 128 to discharge the gas at a location away from the manifold 41.

As seen in FIG. 1, the return port 33 is connected via the quick connect coupling 30 to the return hose 18 which passes through the fill port 25 and back to the tank 13 on the truck 11. During filling, a mechanical tongue 126 located in the port 33 depresses a check valve 77 housed within the valve manifold 41 upstream from the exit port 33 and opens the relief valve 103 to the return line 18, while at the same time closing the vent-to-atmosphere port 128.

Figure 6:
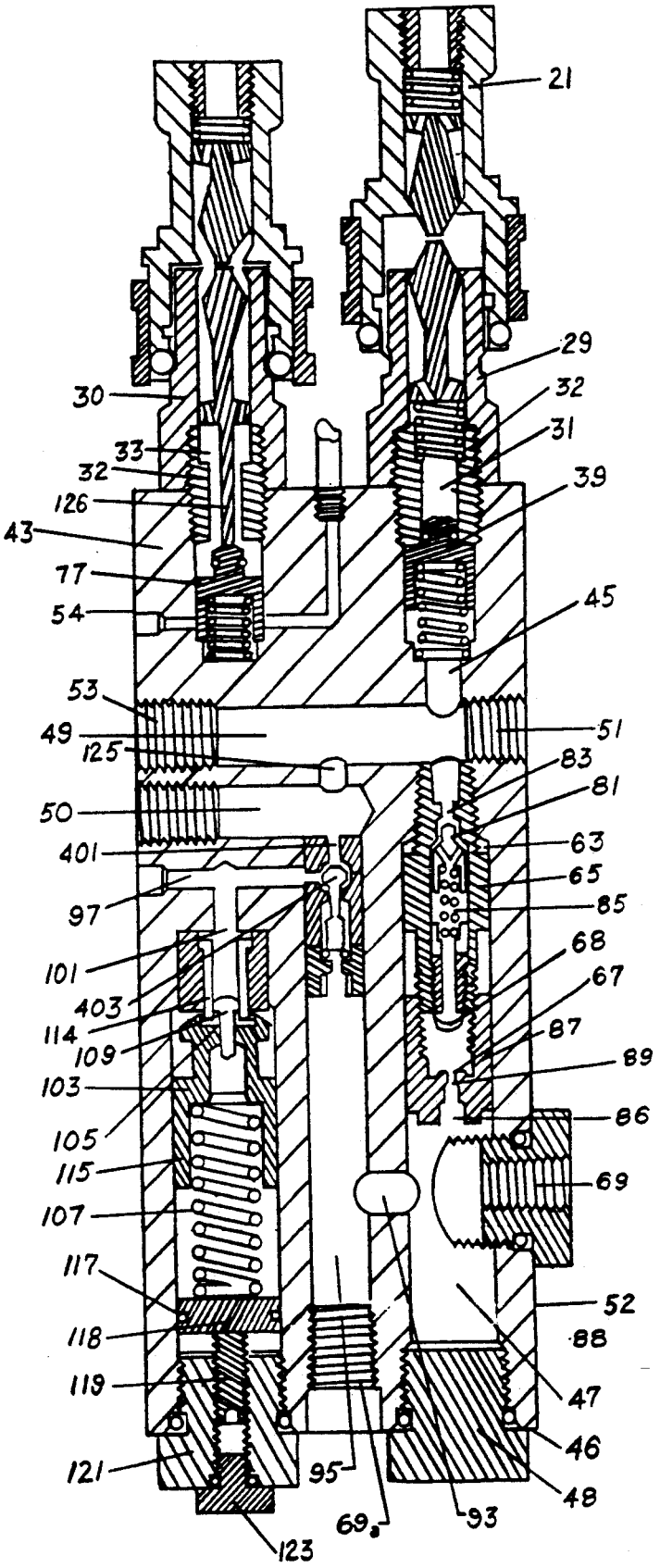
FIG. 6 is a horizontal cross-section similar to FIG. 5 but showing an alternative form of valve manifold.

FIG. 6 illustrates an alternative form of valve manifold 41 in which parts that are equivalent to parts of the valve manifold 41 shown in FIGS. 4 and 5 are given the same reference number. The manifold shown in FIG. 6 incorporates additional parts used to enhance performance and provide for electric control, in place of the mechanical control employed in FIGS. 4 and 5.

As seen in FIG. 6, the alternative form of valve manifold 41 comprises, similarly to the manifold shown in FIGS. 4 and 5, ports 31 and 33 in an end face 44, an internal passage 45 housing a check valve 48, a pressure differential valve 65, a check valve 67, and exit ports 51, 53 and 69. In this alternative form of valve manifold 41, however, a central passage 401 extends from the cross-bore 49 and communicates via a shuttle valve 403 with the relief valve chamber 101. The shuttle valve 403 acts as a sequence diverter valve and distinguishes between gas and liquid pressures, opening if the gas pressure in the bottle 73 becomes greater than the liquid pressure in the bottles 55 and 57. This allows either liquid or gas access to the relief valve chamber 101 and hence, the venting of either to atmosphere through the port 128.

If the overall system pressure exceeds 1200 psi but remains less than 1700 psi, all the storage tanks remain in dynamic balance (the normal operating or filling state). When the pressure in either the liquid or gas storage bottles exceeds 1,700 psi, because of thermal expansion caused by excessive heat (i.e., fire), the relief valve 103 is ported to an auxiliary kick-down or system dump valve 131 connected to the valve manifold body 43 below the sequence diverter valve 403, allowing the entire contents of the system to exhaust to atmosphere, insuring the tanks never explode or burst their safety pressure pop-off discs and discharge $CO_2$ inside the building.

Figure 7:
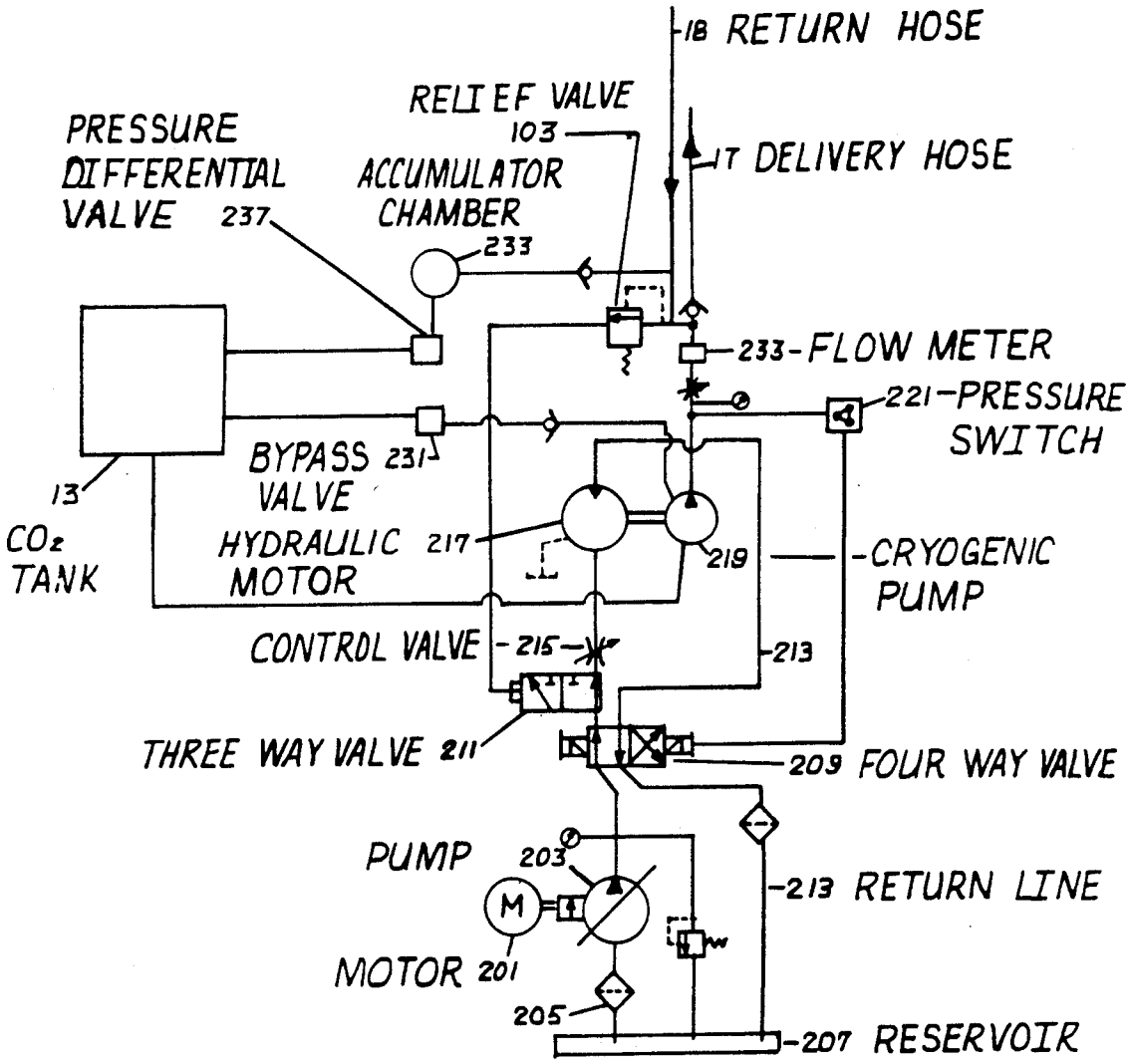
FIG. 7 is a general schematic of the hydraulic control system of the apparatus of FIG. 1.

FIG. 7 shows schematically the hydraulic control system for the apparatus. An engine 201 provided on the truck 11, drives a hydraulic pump 203, which is a pressure compensated, variable displacement pump, or a positive displacement pump, or the PT0 of the truck. The pump 203 withdraws hydraulic fluid, via a strainer 205, from a reservoir 207 of hydraulic fluid provided on the truck 11. The pump 203 delivers the fluid under pressure to a solenoid-operated four-way valve 209, which selectively delivers the fluid either to a mechanically-operated three-way valve 211, or, via a return line 213, back to the hydraulic reservoir 207. The output of the 3-way valve 211, in its transmitting position, delivers fluid to a pressure flow control valve 215, which allows variable flow and pressure control of the hydraulic fluid.

The output from the control valve 215 drives a hydraulic motor 217, which, in turn drives a cryogenic pump 219 connected to the liquid $CO_2$ storage tank 13. The pump 219 delivers liquid $CO_2$ to the hose 17. The spent hydraulic fluid is returned from the hydraulic motor 217 via the return line 213 to the reservoir 207. A bypass valve 231 is located between the storage tank 13 and the pump 219 and circulates liquid $CO_2$ through the pump, hose 17 and flow meter 233. The $CO_2$ pump 219 delivers $CO_2$ at high pressure to the flow meter 233 and then to the delivery hose 17. The flow meter 233 may be either mechanized or electrical.

The control circuit utilized in the liquid $CO_2$ section during filling provides a closed loop system that prevents $CO_2$ venting to atmosphere. When the system is full, a pressure signal from the high-pressure outlet line 17 of the $CO_2$ cryogenic pump 219 initiates the shut-off of power to the hydraulic motor, which drives the pump 219. In one form of the circuit, an electrical pressure switch 221 measures the $CO_2$ pressure in the output of the cryogenic pump 219 and, in response to an undesirably high pressure, actuates the four-way valve 209 to interrupt the supply of hydraulic fluid to the hydraulic motor 207 and lock that motor in a non-rotational condition.

In a second safety feature of the control circuit, operation of the relief valve 103, allowing liquid $CO_2$ to flow through the relief valve 103, is sensed through the return line 18 and produces a signal actuating the three-way valve 211, again interrupting the supply of hydraulic fluid to the hydraulic motor 217.

Both the three way valve 211 and the four way valve 209 are supplied with manual override mechanisms which allow the operator to shut down the system at will. If the system does not shut down and the fill process continues, causing the valve 103 to release pressurized gas into the return line 18, that gas is ported to an accumulation chamber 235 on the truck 11. The purpose of the accumulation chamber 235 is to receive returning high-pressure $CO_2$ and then divert it through a pressure differential valve 237, reducing its pressure to a value below the pressure in the storage tank 13, thus allowing the liquid to be returned to the tank 13. After the high-pressure filling operation ends, the by-pass valve 231 is opened to return excess $CO_2$ trapped in the accumulation chamber 235 to the tank 13 at a position below its liquid level, in order to help it reliquify.

The $CO_2$ delivered from the cryogenic pump 219 may be sent to an electronic or mechanical flow meter. The use of an electronic or mechanical flow meter will not only regulate the flow rate, but will allow for flow totalization, the ability to perform batch processing in a predetermined amount into the fill system and print the customers invoice ticket.

Use of the alternative form of valve manifold 41 shown in FIG. 6 requires the use of power and sensor lines from the truck in conjunction with the fill hoses 17 and 18. These lines could be wrapped in order to form a single umbilical from the truck reel.

While several versions of a high-pressure bulk delivery system embodying the present invention are described in detail herein, it should be apparent that they are given by way of example only and that many alternative designs embodying the invention could be developed by those skilled in the art.

What is claimed is:

1. A valve manifold for use in a system for charging storage cylinders with liquid, inert, cryogenic gas, comprising a valve manifold body, an inlet to said body for receiving liquid gas at a relatively high pressure, exit ports for connecting one or more storage cylinders to the manifold valve body to receive the liquid gas at said relatively high pressure, phase transformation means disposed downstream from said exit ports, which receive incoming liquid gas and allow a controlled transition of the liquid to gaseous phase, said transformation means including a pressure reduction valve, a choke and an expansion chamber, which is connected to a further exit port for gaseous phase gas, said pressure reduction valve of the transformation means being disposed immediately upstream from the choke and the choke comprises a diffusion means for dispersing the liquid gas into a chamber having a relatively small exit through which the liquid gas passes to the expansion chamber.

2. A valve manifold according to claim 1 wherein the diffusion means comprises a foraminous member through which the liquid gas passes into a chamber which includes means for restricting the flow of gas to cause turbulence therein.

3. A valve manifold according to claim 1 including a relief valve communicating with the expansion chamber and adapted to open, in response to a pressure greater than a pre-selected maximum, a vent-to-atmosphere port of the valve manifold downstream from the expansion chamber.

4. A valve manifold according to claim 1 including a sequence diverter valve means communicating with a chamber housing a relief valve connected to receive both gas after its expansion and transformation to gaseous phase and liquid phase gas from the inlet of the manifold.

* * * * *